US008973842B2

(12) United States Patent
Dreyer

(10) Patent No.: US 8,973,842 B2
(45) Date of Patent: Mar. 10, 2015

(54) TRADEABLE PACKET FOR HOLDING A PORTABLE DATA STORAGE MEDIUM, AND SUITABLE PORTABLE DATA STORAGE MEDIUM

(75) Inventor: Manfredo Dreyer, Nersingen (DE)

(73) Assignee: Giesecke & Devrient GmbH, Munich (DE)

( * ) Notice: Subject to any disclaimer, the term of this patent is extended or adjusted under 35 U.S.C. 154(b) by 1590 days.

(21) Appl. No.: 12/294,950

(22) PCT Filed: Mar. 27, 2007

(86) PCT No.: PCT/EP2007/002690

§ 371 (c)(1),
(2), (4) Date: Sep. 29, 2008

(87) PCT Pub. No.: WO2007/112884

PCT Pub. Date: Oct. 11, 2007

(65) Prior Publication Data

US 2010/0320276 A1 Dec. 23, 2010

(30) Foreign Application Priority Data

Mar. 28, 2006 (DE) ..... 10 2006 014 270
Jan. 16, 2007 (DE) ..... 10 2007 002 289

(51) Int. Cl.

| | |
|---|---|
| ***G06K 19/06*** | (2006.01) |
| ***B65B 9/04*** | (2006.01) |
| ***B65B 25/14*** | (2006.01) |
| ***B65B 61/02*** | (2006.01) |

(52) U.S. Cl.

CPC . *B65B 9/04* (2013.01); *B65B 25/14* (2013.01); *B65B 61/025* (2013.01)

USPC ..... 235/494

(58) Field of Classification Search

USPC ..... 235/494; 206/459.5; 53/396

See application file for complete search history.

(56) References Cited

U.S. PATENT DOCUMENTS

| | | | | |
|---|---|---|---|---|
| 5,054,271 | A | 10/1991 | DeWoskin | |
| 5,505,494 | A | 4/1996 | Belluci et al. | |
| 5,541,395 | A | 7/1996 | Hill et al. | |
| 5,760,381 | A * | 6/1998 | Stich et al. | 235/380 |
| 6,328,341 | B2 * | 12/2001 | Klure | 283/62 |
| 6,898,299 | B1 | 5/2005 | Brooks | |

(Continued)

FOREIGN PATENT DOCUMENTS

| | | | |
|---|---|---|---|
| DE | 40 20 578 | A1 | 2/1991 |
| DE | 44 15 667 | A1 | 11/1995 |

(Continued)

OTHER PUBLICATIONS

International Search Report in PCT/EP2007/002690, Jul. 4, 2007.

*Primary Examiner* — Rafferty Kelly
(74) *Attorney, Agent, or Firm* — Workman Nydegger

(57) ABSTRACT

A method for producing a marketable package including an outer packaging for receiving a portable data carrier, and a portable data carrier. The data carrier possesses a viewing side and an underside and bears a secret code internally as well as identification information on the outer side. The identification information is applied to the underside of the data carrier in the form of a two-dimensional bar code, and the outer packaging is configured to be transparent on the underside so that the identification information can be read out through the outer packaging after the data carrier has been inserted into the outer packaging.

19 Claims, 5 Drawing Sheets

(56) References Cited

U.S. PATENT DOCUMENTS

| | | | | |
|---|---|---|---|---|
| 6,971,519 | B2 * | 12/2005 | Fries | 206/454 |
| 2003/0189095 | A1 | 10/2003 | Tuilier | |
| 2007/0063052 | A1 * | 3/2007 | Chakiris et al. | 235/486 |

FOREIGN PATENT DOCUMENTS

| | | | |
|---|---|---|---|
| DE | 44 38 460 | A1 | 5/1996 |
| DE | 20 2005 019 161 | U1 | 2/2006 |

* cited by examiner

TRADEABLE PACKET FOR HOLDING A PORTABLE DATA STORAGE MEDIUM, AND SUITABLE PORTABLE DATA STORAGE MEDIUM

FIELD OF THE INVENTION

This invention relates to packaging series-produced portable data carriers suitable for identifying a user into marketable individual packages. The invention relates in particular to packaging SIM modules (subscriber identity modules) into individual packages.

BACKGROUND

U.S. Pat. No. 5,541,395 A discloses a method for packaging magnetic stripe cards into envelopes. The magnetic stripe cards and the envelopes are printed with matching information, e.g. the name of a future card holder. The information is also coded into the magnetic stripe and printed on the envelope again in the form of a machine-readable bar code. Before magnetic stripe card and envelope are joined together, the applied information is checked for a match. For this purpose the magnetic stripe on the one hand and the machine-readable bar code on the other hand are read out. This method permits the packaging process to be carried out by machine and makes sure that personalized cards are put only into the particular associated envelopes. The method presupposes that the envelopes are completely personalized when they are brought together with the cards to be packaged. It is not suitable for applications where the individualization of a package is effected only after joining with a data carrier to be packaged.

U.S. Pat. No. 5,054,271 A discloses a method for packaging an object in an outer packaging which is transparent in the area of the object. The outer packaging comprises substantially a shaped transparent plastic material which is held by a support frame made e.g. of paper.

U.S. Pat. No. 5,505,494 A further discloses an identity card which is provided on one side with information identifying a person, such as in particular a photo, and personal data, and which bears on the back side a two-dimensional bar code. The two-dimensional bar code contains in machine-readable form likewise the data identifying the person. Two-dimensional bar codes contain in encrypted form information along a principal direction as well as perpendicular to said principal direction. Two-dimensional bar codes are known in different embodiments, e.g. under the name PDF 417 or as a so-called matrix code, which are both described in international standards.

DE 44 15 667 A1 discloses a method for producing a chip card dispatch unit which comprises an envelope into which a cover letter as well as a dispatch envelope with one or more chip cards are inserted. The dispatch envelope comprises a series of contiguous single pockets which have e.g. been cut off from an endless dispatch envelope. A chip card is placed in each single pocket. Dispatch envelope and cover letter are each provided with a matching identification code. A plurality of dispatch envelopes can bear the same identification code. Dispatch envelopes and cover letters are brought together with reference to the identification code. Plain text chip card data can further be provided on a chip card. Plain text data can likewise also be applied to the envelope or the back side thereof. The application of the plain text data is effected completely independently of each other. The success of the method depends on correct application of the identification codes to dispatch envelopes and cover letters. If an error occurs here, this leads to a misassignment of chip cards and cover letters.

DE 40 20 578 A1 further discloses a solution for applying to an envelope a machine code corresponding to the stipulations of a national post office. For this purpose, the actual letter is first to be provided with not only a plain text address but also a machine code readable by an internal reading station. The address field is thereupon placed in the window of a window envelope. The internal machine code is subsequently read automatically through the window and a machine code corresponding to the stipulations of the particular national post office generated therefrom. The latter code is finally printed on the outside of the envelope. A thus processed letter can fundamentally also include enclosures. This solution is based completely and focuses exclusively on the handling of usual postal letters.

SUMMARY

It is the object of the invention to specify a method for packaging portable data carriers in marketable packages which permits small-sized portable data carriers to be put into outer packagings which are individualized to the data carrier after incorporation.

According to the invention, the ID information associated with the data carrier is no longer, as hitherto, applied to the viewing side of the data carrier but to the underside thereof and read out from there through the outer packaging in order to recover the ID information and be able to apply it to the outer packaging. Applying the ID information to the underside of the data carrier has the advantage that as a rule the total area of the data carrier can be used and the ID information can accordingly be formed over a larger area or more extensively. By the readout of the ID information being effected after the placement of the data carrier in the outer packaging, a direct linkage according to the method between information taken directly from a data carrier and the corresponding information applied to the outer packaging ensures that the data carrier belonging to ID information is actually located in the outer packaging. There are no special steps for assigning ID information to a data carrier, e.g. breaking small-sized data carriers out of larger carriers on which the ID information is located. By the portable data carriers being capable of being handled in their final size for packaging, the inventive method permits fully automated packaging of very small-sized data carriers. The latter can advantageously be supplied in particular in a roll or in the form of strips from which they are singled by machine for packaging. The inventive method is particularly advantageously suitable for packaging SIM cards or chip cards of comparable or even smaller size which are supplied in a roll or in strips each having a plurality of single cards.

In a particularly advantageous embodiment, the ID information is applied in the form of a two-dimensional bar code. Preferably, the ID information is moreover invisible or at least poorly recognizable to the naked eye and only readable with a special reading device. To support the readout, the package is preferably configured to be transparent at the location of placement of the data carrier. By the readout of the ID information from the underside of the data carrier, the supplying of the secret code contained on the data carrier is preferably controlled. With reference to the drawing, an embodiment of the invention will hereinafter be explained in more detail.

BRIEF DESCRIPTION OF THE DRAWINGS

Therein is shown.

DETAILED DESCRIPTION OF VARIOUS EMBODIMENTS OF THE DISCLOSURE

Figure 1:
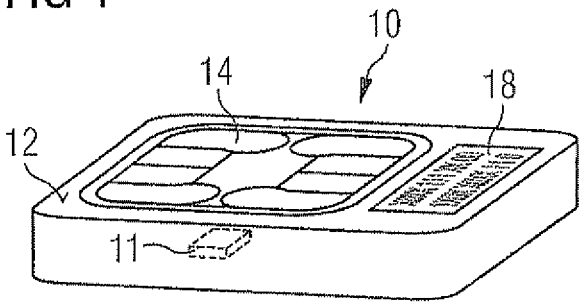
FIG. 1 a perspective plan view of the viewing side of a portable data carrier, FIG. 2 a perspective plan view of the underside of a portable data carrier, FIG. 3 a package containing a portable data carrier and an extra item in cross section, FIG. 4 the supplying of data carriers to be packaged in a roll, FIG. 5 the singling of portable data carriers supplied in a strip, FIG. 6 a flow chart of the inventive production method, FIG. 7 a variant of a package, FIG. 8 the basic principle of a realization of the inventive method, and FIG. 9 a lower form with an inserted module fed from a magazine in a partially perspective view.
Figure 2:
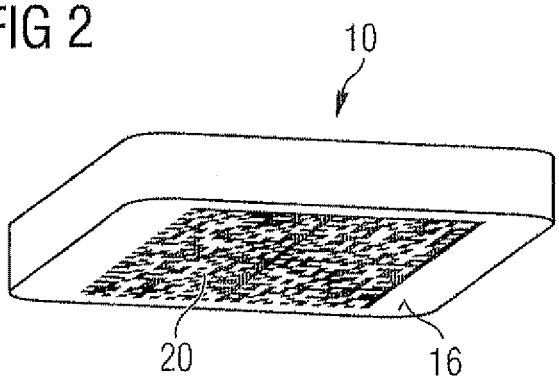

The following description will assume a known, standard SIM module as indicated in FIGS. 1 and 2 as the embodiment of a portable data carrier to be packaged. The assumption of a SIM module as the embodiment of a portable data carrier 10 is made here only by way of example for the purposes of easier description. The proposed method is nevertheless also suitable with the same success for other data carrier designs having a viewing side considerably occupied by technical or informative elements and an unoccupied or little occupied underside.

The SIM module 10, referred to hereinafter simply as the module, possesses a flat, approximatively rectangular form with a viewing side 12 on which a contact pad 14 is formed, and a plane underside 16. In the module 10 there is, inaccessible from outside, a chip 11 in which a secret software code is stored. The chip is connected to the contact pad 14. The contact pad 14 typically covers more than half of the viewing side 12. In the remaining free area of the viewing side 12 there is an information field 18 in which information about the module is rendered. The information field 18 typically contains identification information for unique designation of the module 10 as well as information on the distributor of the module 10.

There is applied to the underside 16 of the module 10 a machine-readable code 20 the readout of which requires a reading device 70. The machine-readable code 20 is preferably a two-dimensional bar code, this execution being assumed hereinafter. The bar code 20 expediently covers the whole or the predominant part of the underside 16, thereby obtaining a maximally large-area execution of the partial areas of the bar code 20. The bar code 20 likewise contains the identification information serving to uniquely designate the module 10. In addition the two-dimensional bar code 20 can contain further information, such as information on the distributor of the module 10, on the module manufacturer or on special features of the module 10. The two-dimensional bar code 20 can also contain control information by means of which the secret software code located in the chip 11 of the module 10 is identifiable. The two-dimensional bar code 20 is preferably executed so as to be invisible or at least poorly recognizable to the naked eye. It is for example so constituted that it is only visible in ultraviolet light. The two-dimensional bar code 20 is expediently a "matrix code", as defined in the international standard ISO/IEC 16022. In this embodiment it can be read omnidirectionally by means of CCD camera scanners, whereby successful reading is even possible when up to 25% of the code could not be recognized. In addition, however, other embodiments are also possible, e.g. according to the type "PDF 417".

Figure 3:
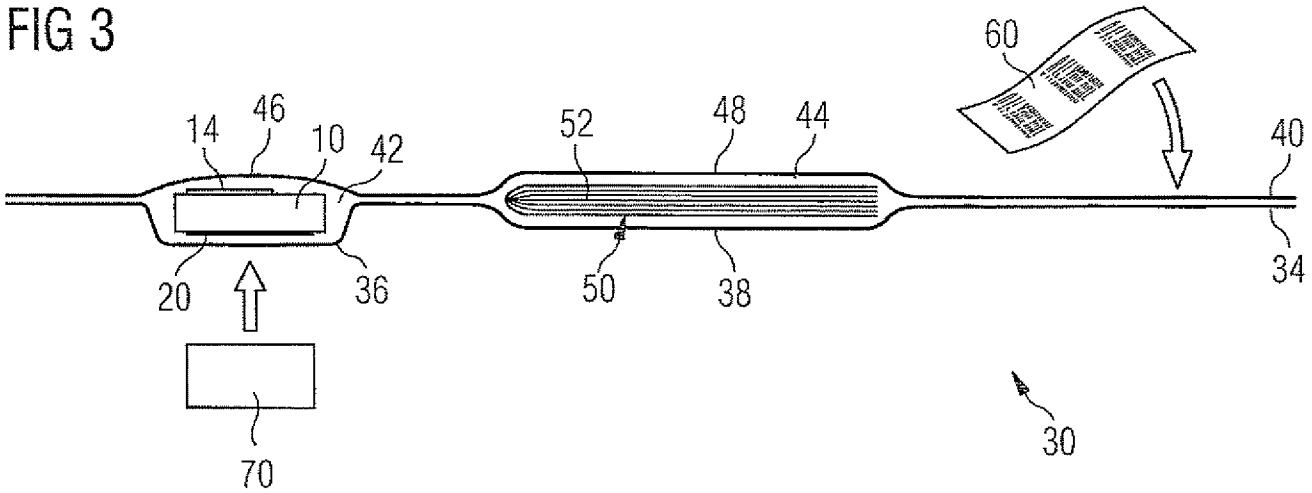

For delivery to an end customer, the module 10 is packaged into a marketable package 30, as illustrated in FIG. 3. The marketable package 30 permits dispatch of the contained goods, i.e. the module 10, and can be delivered to a final consumer without any further effort.

The package 30 comprises a outer packaging having the module 10 as well as an extra item 50 incorporated therein and a label 60 or a print applied to the outer side thereof. The outer packaging is constituted by joining a lower form 34 and an upper form 40 and has cavities 42 and 44 which enclose the module 10 and the extra item 50. The cavities 42 and 44 are constituted by hollows 36, 38 and 46, 48 of matching shape which are formed in the lower form 34 and upper form 40. The hollows 36, 38, 46, 48 define a fixed placement within the outer packaging for the module 10 and the extra item 50 in each case and fix them in slip-proof fashion. The total outer packaging, but at least parts thereof, are executed to be transparent. Preferably, in particular the upper form 40 is configured to be transparent in such a way that the viewing side 12 of the module 10 and the extra item 50 are visible through the upper form 40. Lower form 34 and upper form 40 are expediently interconnected along the edges by suitable methods such as welding, bonding or riveting. The extra item 50 contains information about the module 10. It typically contains instructions for use as well as further a rendition of the secret software code of the module 10. The secret code is expediently rendered on a sheet 52 which is so inserted into the extra item 50 that it cannot be read from outside in an unopened extra item 50. The extra item 50 expediently also contains, preferably on the sheet 52, the identification information contained in the information field 18. The extra item 50 is typically a booklet or leaflet.

The label 60 preferably bears in plain text likewise the identification information serving to uniquely designate the module 10. It is applied to the outer side of the outer packaging, preferably to the outer side of the upper form 40, after closure of the outer packaging by joining of the lower form 34 and upper form 40. In connection with the identification information contained in the information field 18 on the module 10, the label 60 permits a check of whether module 10, extra item 50 and label 60 belong together. The label 60 can in addition have applied thereto information about dealing with the package 30, for example logistical information. The label 60 comprises in the way known in the art an adhesive carrier on which information is printed. In a variant, the adhesive carrier can be omitted and the information applied directly to the upper form 40, e.g. by printing or with the help of a laser.

Figure 4:
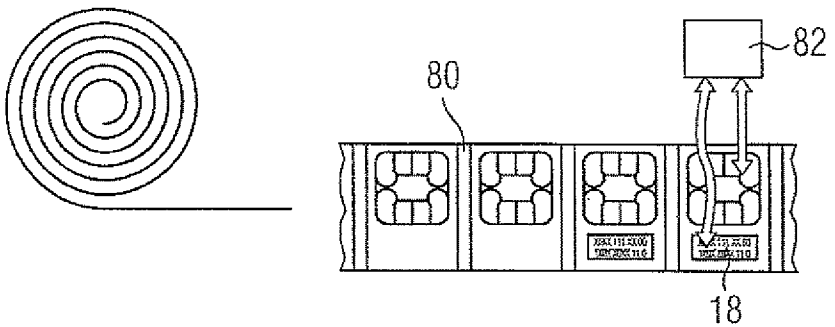
Figure 6:
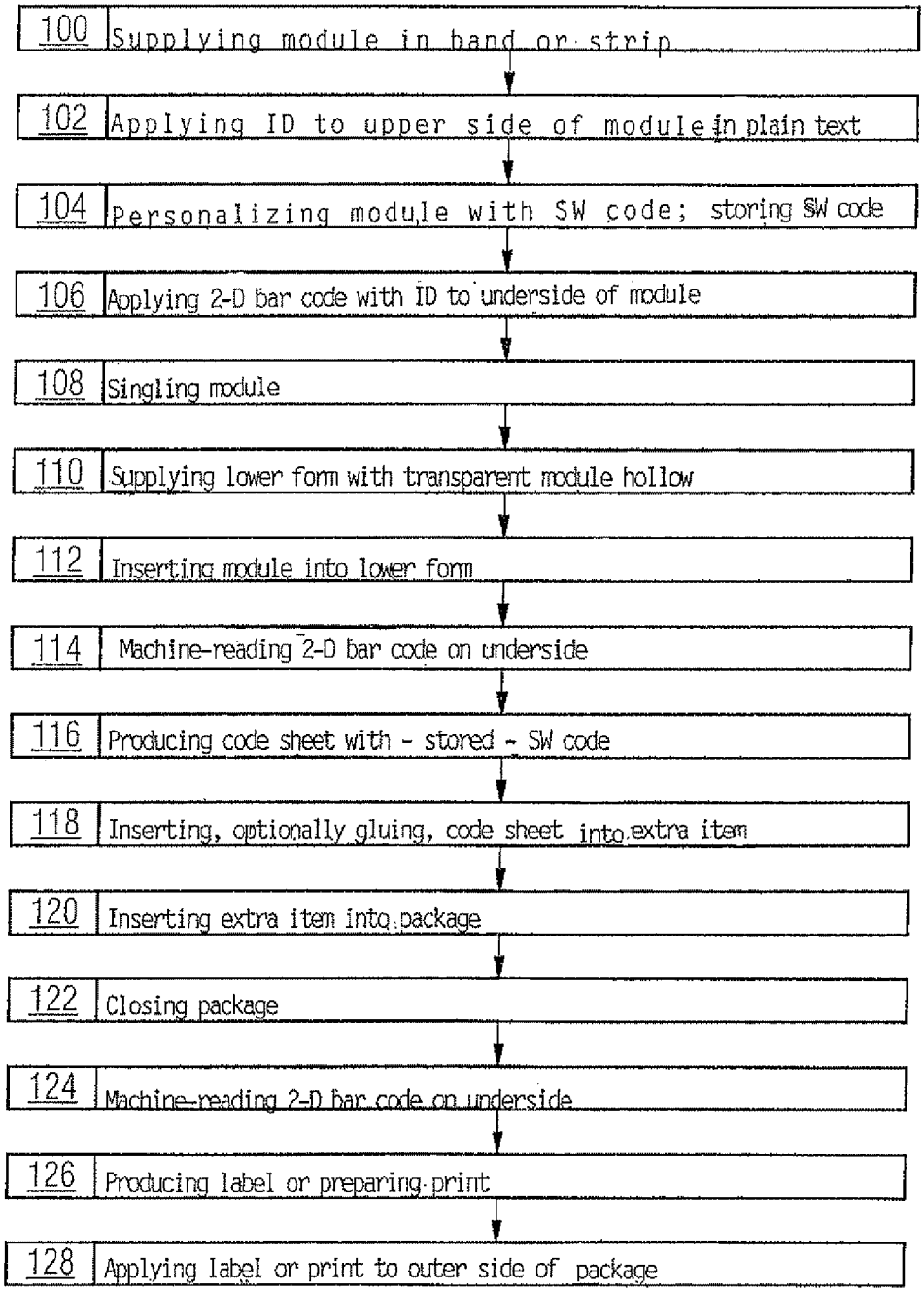
Figure 7:
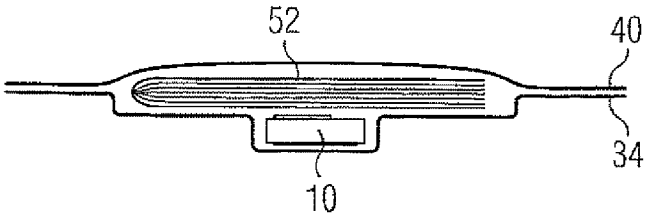

With reference to the flow chart rendered in FIG. 6, the production of the marketable package 30 shown in FIG. 1 will hereinafter be described. The production begins, step 100, with the supplying of a module 10. The module 10 can be supplied here, as illustrated in FIG. 4, in particular in the form of a roll or in the form of strips each having a plurality of modules 10. The individual modules 10 are still interconnected here by bars 80 to be removed later. Depending on the separation technology later applied, however, the bars 80 can also be omitted. If the modules 10 possess a longer and a shorter principal axis, as is the case in particular with the assumed SIM modules, they are preferably connected in the roll or strip along the longer principal axis, as indicated in FIG. 4.

The module 10 is first individualized graphically, step 102. For this purpose, identification information uniquely characterizing the module 10 is applied to the information field 18 on the viewing side 12 of the supplied modules.

Subsequently, the module 10 is personalized electrically, step 104. For this purpose, a secret software code is generated and inscribed into the chip 11 of the module 10. The secret software code typically comprises, in the case of SIM modules, a PIN and a PUK for identification of a subscriber vis-à-vis a mobile communication network. The secret software code written into the chip 11 is further stored in a production database 82 outside the module 10 together with the identification information applied in step 102.

In the following step 106 the two-dimensional bar code 20, which likewise contains the identification information as well as optionally further information, is applied to the underside 16 of the module 10.

The execution of steps 102 to 106 can be effected completely in the roll or strip.

Figure 5:
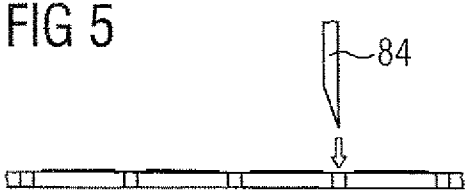

If they are still connected, e.g. by being present in a roll or strip, the modules 10 are singled in the following step 108. A possible manner of singling is illustrated in FIG. 5. It can be effected, as indicated in FIG. 4, with the help of a mechanical separating device 84 which separates the modules 10 from the strip or roll directly in their final size. Any other known technology can in addition also be used for singling.

For producing the package 30 the lower form 34 is thereupon supplied, step 110. In the lower form 34 there are hollows 36 and 38 formed for receiving the module 10 and the extra item 50. At least the hollow 36 is configured to be transparent so that the two-dimensional bar code 20 can subsequently be read out through the lower form 34 by means of a reading device 70. The module 10 is inserted into the hollow 36 formed for receiving the module 10, step 112.

After placement of the module 10 in the hollow 36 the two-dimensional bar code 20 is read out by means of a reading device 70 in a following step 114. From the read-out two-dimensional bar code 20 the identification information contained therein is determined. With access to the production database 82 the secret software code belonging to the data carrier 10 and stored in step 104 is thus determined. Said code is transferred, preferably in plain text, to a sheet 52, step 116, which is thereupon inserted or optionally also glued into the extra item 50, step 118.

The extra item 50 is thereafter likewise inserted into the hollow 38 likewise provided therefor in the lower form 34, step 120. In a variant, the extra item 50 is first inserted into the prepared hollow 38 without the sheet 52 together with the module 10, and the sheet 52 then inserted in the extra item 50 placed in the hollow 38.

Subsequently, lower form 34 and upper form 40 are joined together and the package 30 thus closed, step 122.

After closure, the two-dimensional bar code 20 on the underside of the module 10 is again read out through the lower form 34 by means of a reading device 70, which can be a different one from that used for the first readout in step 114, step 124. From the read-out bar code 20 the identification information contained therein is determined and, preferably in plain text, applied to a label 60, step 126. The label is thereupon applied to the outer side of the package 30, step 128. In a variant for applying a label 60, the identification information is applied directly to the outer side of the package 30, preferably as a print. In step 126 there is effected in this case a preparation of a print, which is then applied in step 128. For direct application it is possible to use in particular known printing methods, such as printing by means of an ink jet printer or blackening the outer side of the package by means of a laser beam.

The label 60 or the print is preferably placed on the outer side of the upper form 40, so that it can be read out from the same side as the information field 18 on the module 10. Together with the identification information, further information can be applied to the label 60, e.g. information on the product identification for trade or information on the manufacturer of the module 10. The additional information can also be applied in machine-readable form, in particular as an ordinary bar code or again as a two-dimensional bar code.

FIGS. 7 to 10 illustrate a realization of the above-described method by means of consecutive processing stations 86, 88, 90. At the processing stations 86, 88, 90 there are disposed magazines 92, 94, 96 from which the modules 10, the extra items 50 and the labels 60 are fed in each case. The product produced is a variant of a package 30 in which, unlike the embodiment according to FIG. 3, the two hollows 36, 38 for receiving module 10 and extra item 50 are formed one above the other in the form of a two-step hollow, the package 30 being shown in cross section in FIG. 7. The information field 18 is covered by the extra item 50 with this arrangement and can only be read after the package 30 is opened.

Figure 8:
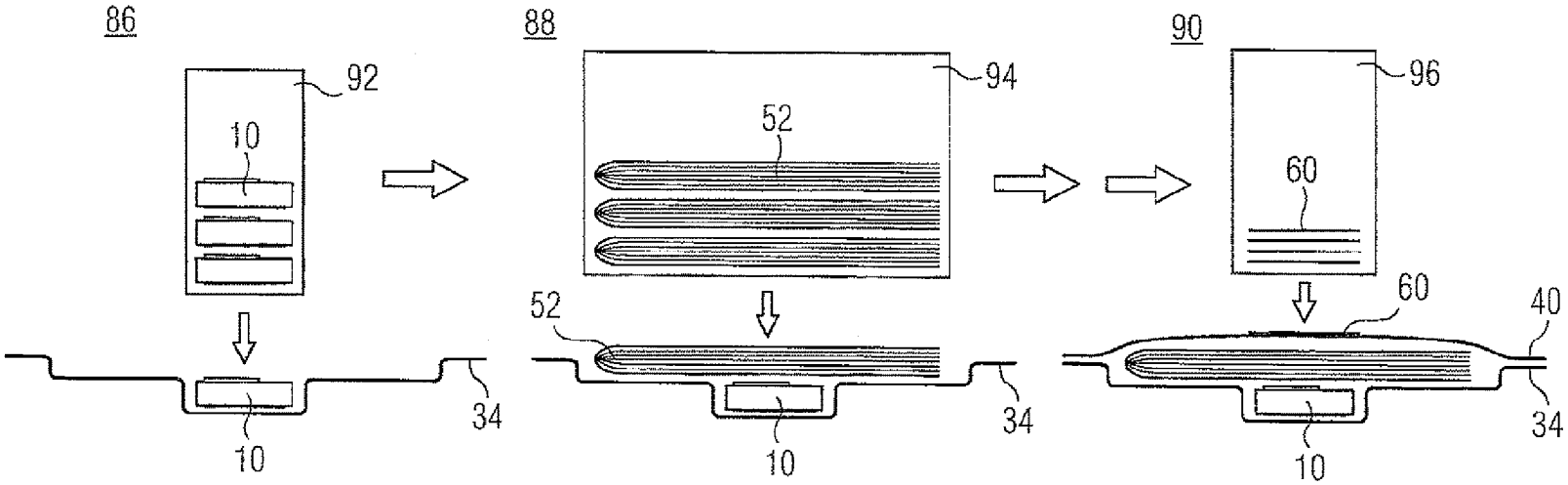
Figure 9:
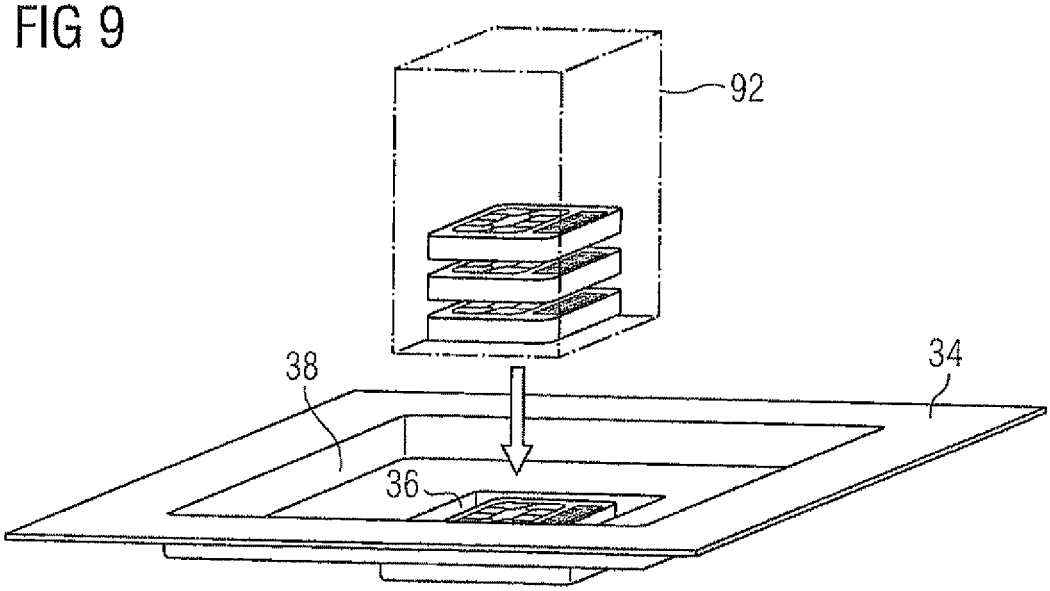

FIG. 8 shows the basic principle of this realization. At a first processing station 86 the steps 110 and 112 are executed, i.e. the lower form 34 is supplied and the previously singled-module 10 inserted thereinto. The module 10 is thereby inserted into the smaller, deeper hollow 36, as illustrated in FIG. 9 in a partially perspective view. The module 10 is preferably fed from a magazine 92.

The lower form 34 is subsequently conveyed on to a following processing station 88 where steps 114 to 120 are executed. In step 120 the extra item 50 is placed over the module 10 into the larger hollow 38, whose base area is constituted substantially by the upper side 12 of the previously inserted module 10. The feed of the extra item 50 is preferably effected likewise from a magazine 94.

The upper form 40 is subsequently placed over the loaded lower form 34 and connected to the lower form 34, so that a closed package 30 arises, this step being indicated in FIG. 8 by a double arrow.

At the following processing station 90, steps 124 to 128 are executed, which end in the application of a label 60 to the outer side of the package 30, as shown. The label 60 is preferably again fed from a magazine 96.

It is evident that, instead of the processing indicated in FIG. 8 at tandem-arranged processing stations 86, 88, 92, the inventive method can also be realized in stationary fashion, by the lower form 34 being supplied at a fixed assembly site and the further steps for producing a package 30 being subsequently executed successively there.

While retaining the basic idea of producing a package receiving a portable data carrier by providing the data carrier on the underside with a two-dimensional bar code and reading out the latter through a package designed to be transparent for this purpose after it has been inserted into the package, the above-described solution allows a multiplicity of variations not individually described here. Thus, individual method steps can be interchanged, such as steps 102 and 104. Steps can also be omitted, such as step 124, by the information read out in step 114 being stored and reused. There is also wide scope for variations in the supplying of the portable data carriers 10. This can of course also already be effected in singled form, but also e.g. in the form of stacks which are broken up by means of suitable separating tools. Besides the extra item, further elements can be inserted into a package and linked with the data carrier 10 by application of information if required. The supplying of the secret code need not be effected from a production data memory 82 but can also be realized for example by calculation from information derived from the two-dimensional bar code 20. For inserting the secret software code into the extra item 50 it is also possible to select a differently configured inlay, instead of a sheet 52. The inlay can be placed in its own hollow separately from the extra item 50. The extra item 50 itself can also possess any other designs apart from a book-like form, being enclosed for example in the form of a CD.

The invention claimed is:

1. A method for producing a marketable package comprising the steps:

producing a portable data carrier having a viewing side and an underside, said portable data carrier containing a secret code, wherein identification information which uniquely identifies the portable data carrier is applied on at least the underside of the portable data carrier, supplying a lower form of an outer packaging having at least one hollow arranged to receive the portable data carrier, incorporating said portable data carrier into said at least one hollow and an extra item having information relating to the portable data carrier into the lower form of the outer packaging, joining an upper form of the outer packaging with the lower form of the outer packaging to close said portable data carrier and extra item in said outer packaging, wherein the upper form of the outer packaging is at least partly transparent so that the viewing side of the portable data carrier is recognizable, reading the identification information on the underside of the portable data carrier through the lower form of the outer packaging, and individualizing the outer packaging to the portable data carrier by applying the read identification information on an outer side of the outer packaging.

2. The method according to claim 1, wherein the identification information is applied to the underside of said portable data carrier in the form of a machine-readable code.

3. The method according to claim 1, wherein the identification information is applied to the underside of said portable data carrier as a two-dimensional bar code.

4. The method according to claim 3, wherein the two-dimensional bar code is applied to the underside of said portable data carrier so as to be invisible or at least poorly recognizable to the human eye.

5. The method according to claim 1, wherein, upon the identification information on the underside of the portable data carrier being read out, the secret code is determined on the basis of the read-out information, and said code transferred to a sheet which is enclosed in the package.

6. The method according to claim 1, further comprising the step forming a hollow for receiving the portable data carrier in the lower form, and manufacturing the lower form from transparent material at the place of the hollow.

7. The method according to claim 6, wherein the identification information is read out after the lower form and upper form are joined together.

8. The method according to claim 1, wherein the identification information is read out and applied to a label after the upper form and the lower form are joined together.

9. The method according to claim 8, wherein the label is applied to the upper form of the outer packaging.

10. The method according to claim 1, wherein the identification information is read out and applied directly to the outer side of the outer packaging after the upper form and lower form are joined together.

11. The method according to claim 1, wherein the secret code is supplied for incorporation into the extra item on the basis of the read-out identification information.

12. The method according to claim 1, wherein the upper form has a different profile than said lower form of the outer packaging.

13. The method according to claim 1, wherein the secret code is a secret software code stored on a chip of the portable data carrier.

14. The method according to claim 1, wherein the identification information includes control information by which the secret software code is identifiable on a chip of the portable data carrier.

15. The method according to claim 1, wherein the extra item contains instructions for use of the secret code.

16. The method according to claim 1, wherein the secret code is rendered on a sheet that is inserted into the extra item.

17. A marketable package comprising:

a portable data carrier having a viewing side and an underside, wherein the portable data carrier comprises a secret code and identification information, and wherein the identification information is applied to at least the underside of the portable data carrier;

an extra item having information relating to the portable data carrier; and an outer packaging having a lower form and an upper form, wherein said lower form has at least one hollow having a recess configured to hold said portable data carrier, and said upper form has a different profile than said lower form, wherein the upper form of the outer packaging is at least partly transparent so that the viewing side of the portable data carrier is recognizable, and wherein the lower form of the outer packaging is transparent for receiving the portable data carrier, and wherein an applied information is applied to an outer side of the outer packaging, wherein the applied information corresponds to the identification information of the portable data carrier that is read through the hollow so that the outer packaging is individualized to the portable data carrier.

18. A portable data carrier for use in a package according to claim 17, having a viewing side with a contact pad formed thereon for connection to an external device, wherein a machine-readable code in the form of a two-dimensional bar code containing identification information is applied to the underside.

19. The portable data carrier according to claim 18, wherein the two-dimensional bar code is invisible or at least poorly recognizable to the human eye.

* * * * *